US006910552B2

(12) United States Patent
Nir

(10) Patent No.: US 6,910,552 B2
(45) Date of Patent: Jun. 28, 2005

(54) RESCUE SYSTEM FOR HIGH-RISE BUILDINGS

(76) Inventor: Eliyahu Nir, 4 Zommerstein Street, 42446 Netania (IL)

( * ) Notice: Subject to any disclaimer, the term of this patent is extended or adjusted under 35 U.S.C. 154(b) by 0 days.

(21) Appl. No.: 10/415,499

(22) PCT Filed: Nov. 5, 2001

(86) PCT No.: PCT/IL01/01021

§ 371 (c)(1),
(2), (4) Date: Apr. 30, 2003

(87) PCT Pub. No.: WO02/38219

PCT Pub. Date: May 16, 2002

(65) Prior Publication Data

US 2004/0011589 A1 Jan. 22, 2004

(30) Foreign Application Priority Data

Nov. 8, 2000 (IL) ..... 139549

(51) Int. Cl.[7] ..... A62B 1/20
(52) U.S. Cl. ..... 182/48; 182/82
(58) Field of Search ..... 182/48, 49, 82

(56) References Cited

U.S. PATENT DOCUMENTS 908,034 A * 12/1908 Pylek ..... 193/25 R
1,520,440 A * 12/1924 Pyleck ..... 193/25 R
4,240,520 A * 12/1980 LaGrone et al. ..... 182/48
4,398,621 A * 8/1983 Baker ..... 182/48

FOREIGN PATENT DOCUMENTS

GB 2124168 A * 2/1984 ..... A62B/1/20
GB 2232138 A * 12/1990 ..... A62B/1/20

* cited by examiner

*Primary Examiner*—Alvin Chin-Shue
(74) *Attorney, Agent, or Firm*—G.E. Ehrlich (1995) Ltd.

(57) ABSTRACT

A system for use in conjunction with emergency rescue sleeves that are mechanically deployed along at least a pair of supporting cables taught between a compacted sleeve storage compartment located at a designated story of a building and an anchor located at a point elsewhere below. The system provides for the slideable extraction of the compacted sleeve storage compartment (150), from the outer wall (110*a*) of a building (110) at the designated escape story, and the parallel and diagonal deployment of the rescue sleeve (112) alongside same exterior wall (110*a*) of the building (110).

12 Claims, 4 Drawing Sheets

RESCUE SYSTEM FOR HIGH-RISE BUILDINGS

FIELD OF THE INVENTION

The present invention relates to rescue systems for evacuating individuals trapped in high rise buildings in case of emergency situations such as fire or earthquake of the type disclosed in PCT/IL00/00477 Patent Application published as WO 01/62138 on Aug. 30, 2001 (hereinafter called "the WO Patent"), the contents of which being hereby incorporated by reference.

BACKGROUND OF THE INVENTION

As clearly follows in light of the description contained in the WO Patent, it has been relied upon that the rescue sleeve, ejected from its storage compartment, becomes unfolded along at least two guiding and supporting cables which are anchored to stationary object(s) located at the ground (street) level, in front of the building in question.

This, however, may not always be practicable due, among other reasons, to the particular environmental conditions prevailing in the immediate surrounding of the building. This is particularly true since a certain minimum distance between the building and the anchoring point must be preserved in order to attain a suitable inclination angle of the sleeve (say 45°), which distance enlarges in proportion to the height of the story from which the evacuation is requested.

It is therefore the prime object of the present invention to overcome this pre-requisite of the WO Patent system.

It is a further object of the invention to provide a rescue sleeve that will be deployed sidewise, parallel to and diagonally along-side a building wall.

SUMMARY OF THE INVENTION

Thus provided according to the invention is a system for the evacuation of individuals trapped in multiple story buildings by gliding down a rescue sleeve, comprising: a sleeve made of sections, each section being made of a sheet material strengthened by a circumferential support member, the sections being connected to each other to form a continuous envelope; at least a pair of cables thread along the sleeve, one at the bottom and one at the top generatrix thereof; a pair of winch systems for winding the cables into a dedicated location at the building story from which rescue is requested, so that the sleeve becomes folded into a compact package within a storage compartment; coil spring operated means for selectively ejecting and unfolding the sleeve down to ground level where it becomes tied to stationary object(s), characterized in that the axis of the storage compartment extends in parallel to the building wall, the compartment being slidably mounted enabling its extraction outside the building so that unfolding the sleeve down to ground level is directed in parallel to and diagonally alongside the exterior wall of the building.

BRIEF DESCRIPTION OF THE DRAWINGS

Further constructional features and advantages of the invention will be more clearly understood in the light of the ensuing description of a preferred embodiment thereof, given by way of example only, with reference to the accompanying drawings, wherein—

DETAILED DESCRIPTION OF THE PREFERRED EMBODIMENT

In the attached drawings, numerals with the prefix "1" will be used to designate parts and components corresponding to those of WO Patent; other parts will bear "2" as a prefix.

Figure 1:
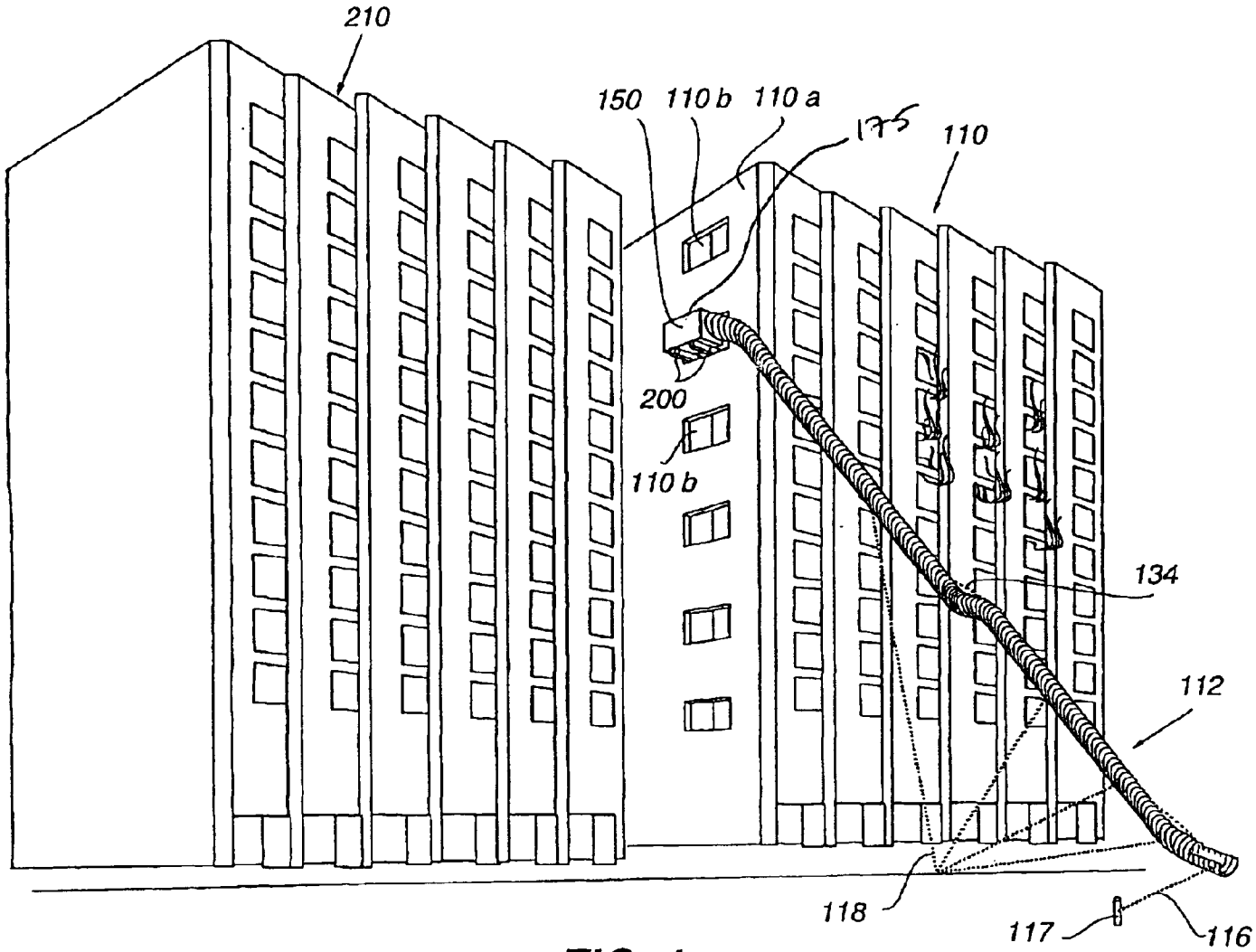
FIG. 1 is a schematic perspective view of the rescue system in the sleeve deployed, operative position enabled according to the present invention.

As seen in FIG. 1, there exists a second building 210 in front of a rescue exit 110*b* of the building 110. Therefore, the deployment of the sleeve 112 straight ahead is obstructed and only possible side-wise, in one or the other directions parallel to the wall 110*a*.

Figure 3:
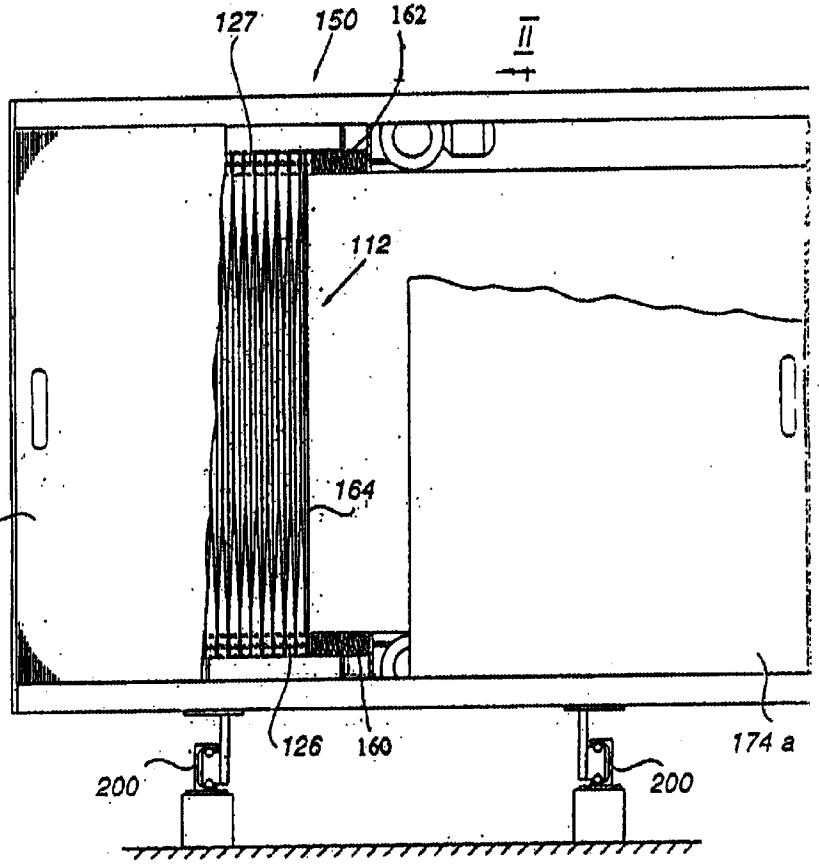
FIG. 3 is a sectional view taken along line III—III of FIG. 2.
Figure 2:
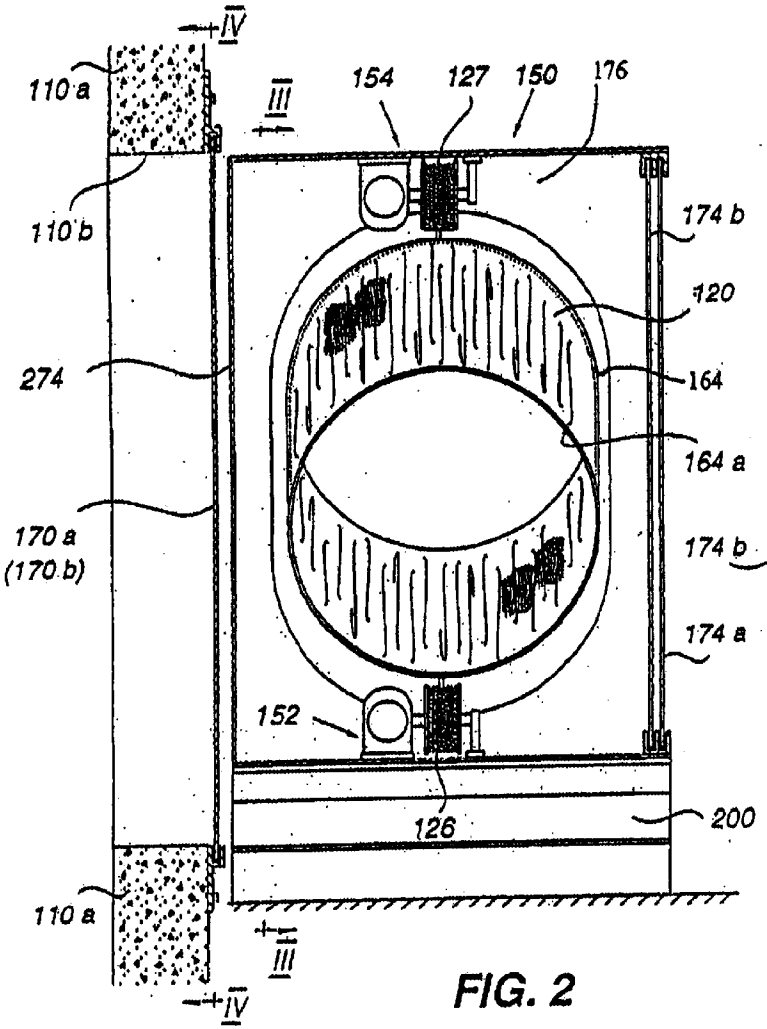
FIG. 2 is a partly sectional view of the sleeve-storage compartment taken along line II—II of FIG. 3.

FIGS. 2 and 3 do not materially differ from those of the WO Patent. However, rather than extending normal to the building wall 110*a* (as seen in FIG. 8 of the WO Patent), the housing defining compartment 150 is parallel to the exterior wall. More particularly, as shown in FIG. 1, and especially in FIGS. 2 and 3, the housing defining compartment 150 is mounted to the building on rails 200 which permit the housing to move linearly from a stored position within the exit opening formed in exterior wall 110*a*, to an operative position, shown in FIG. 1, projecting outwardly from the exterior wall.

Thus, as shown particularly in FIG. 1, flexible sleeve 112 is constructed so as to be foldable into a compact form for storage within compartment 150, and is unfoldable into an operative form extending outwardly from that compartment to permit individuals to exit through the flexible sleeve from the building. As described in the above-cited WO Patent, the flexible sleeve has an entry end secured within compartment 150, and an exit end to be secured to a stable object at a lower level in the extended operative form of the flexible sleeve. In addition, the flexible sleeve is supported in its extended operative form by an upper tension cable, shown at 127 in FIGS. 2 and 3, engageable with an upper portion of each of the rigid rings of the flexible sleeve, and by a lower tension cable 126 (FIGS. 2, 3) engageable with a lower portion of each rigid ring. As described in the WO Patent, the flexible sleeve is constructed of a plurality of rigid annular rings joined together by flexible sheet material; and the tension cables pass through eyelets carried at the upper and lower portions of the respective rigid rings.

Figure 4:
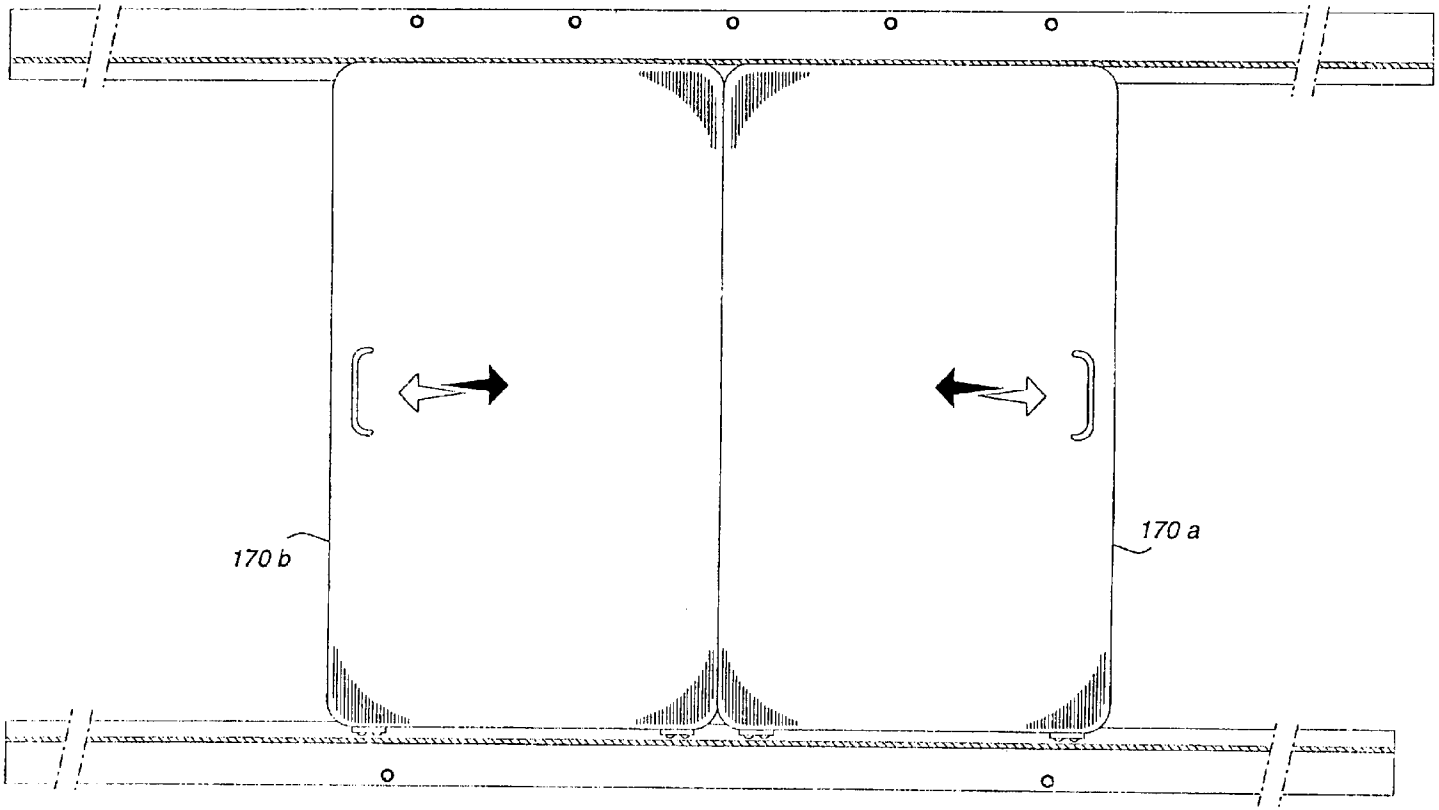
FIG. 4 is a view taken along line IV—IV of FIG. 2.

Housing defining compartment 150 includes a pair of sliding doors 170*a*, 170*b* (FIGS. 2, 4) defining an inner or rear wall adjacent to the exit opening of the building exterior wall 110*a*, and a pair of sliding doors 174*a*, 174*b*, defining an outer or front wall. Both such walls are located vertically and substantially parallel to the building exterior wall and in alignment with the exit opening when the housing is mounted to the building.

The housing defining compartment 150 further includes a pair of lateral walls, shown at 175 in FIG. 1 and at 176 in FIG. 2, respectively, extending vertically on opposite sides of the front and rear walls, and substantially perpendicular to the building exterior wall 110*a*, when the housing defining compartment 150 is mounted to the building.

According to the present invention, one of the lateral walls, namely lateral wall 175 shown in FIG. 1, is formed with an opening through which the entry end of the flexible sleeve 120 extends in the extended operative form of the flexible sleeve. The arrangement is such that, when the sleeve is in its operative form, it extends at an incline diagonally alongside, and substantially parallel to, the building exterior wall 110*a*. Such an arrangement greatly facilitates the securing of the exit end of the flexible sleeve to a stable object located relatively close to the building, while at the same time facilitating the evacuation of individuals entering the flexible sleeve in a sitting position at the entry end of the sleeve.

As seen particularly in FIGS. 2 and 3, compartment 150 further includes first and second winches 152, 154, coupled to the lower tension cable 126 and upper tension cable 127, respectively, for drawing the flexible sleeve into compartment 150. Compartment 150 further includes a backing plate 164 extending parallel to lateral wall 175 (FIG. 1) and formed with an opening 164*a* (FIG. 2) aligned with, and joined to, the entry end of the flexible sleeve 112, providing access into its entry end. Backing plate 164 is movable away from lateral wall 175 to accommodate the flexible sleeve in a folded condition when drawn into the compartment by the winches 152, 154.

As described in the WO Patent, compartment 150 further includes a guide tube 160, 162 (FIG. 3) for each of the tension cables 126, 127 located between the respective winch 152, 154 and the backing plate 164. Such tubes guide the linear displacement of the backing plate. These tubes are spaced apart within compartment 150 a greater distance than the transverse dimension of the entry end of the flexible sleeve 112, such that the flexible sleeve is folded in a zig-zag space-saving fashion when drawn into the compartment, as shown in FIGS. 2 and 3, and as described more particularly in the WO Patent.

Figure 5:
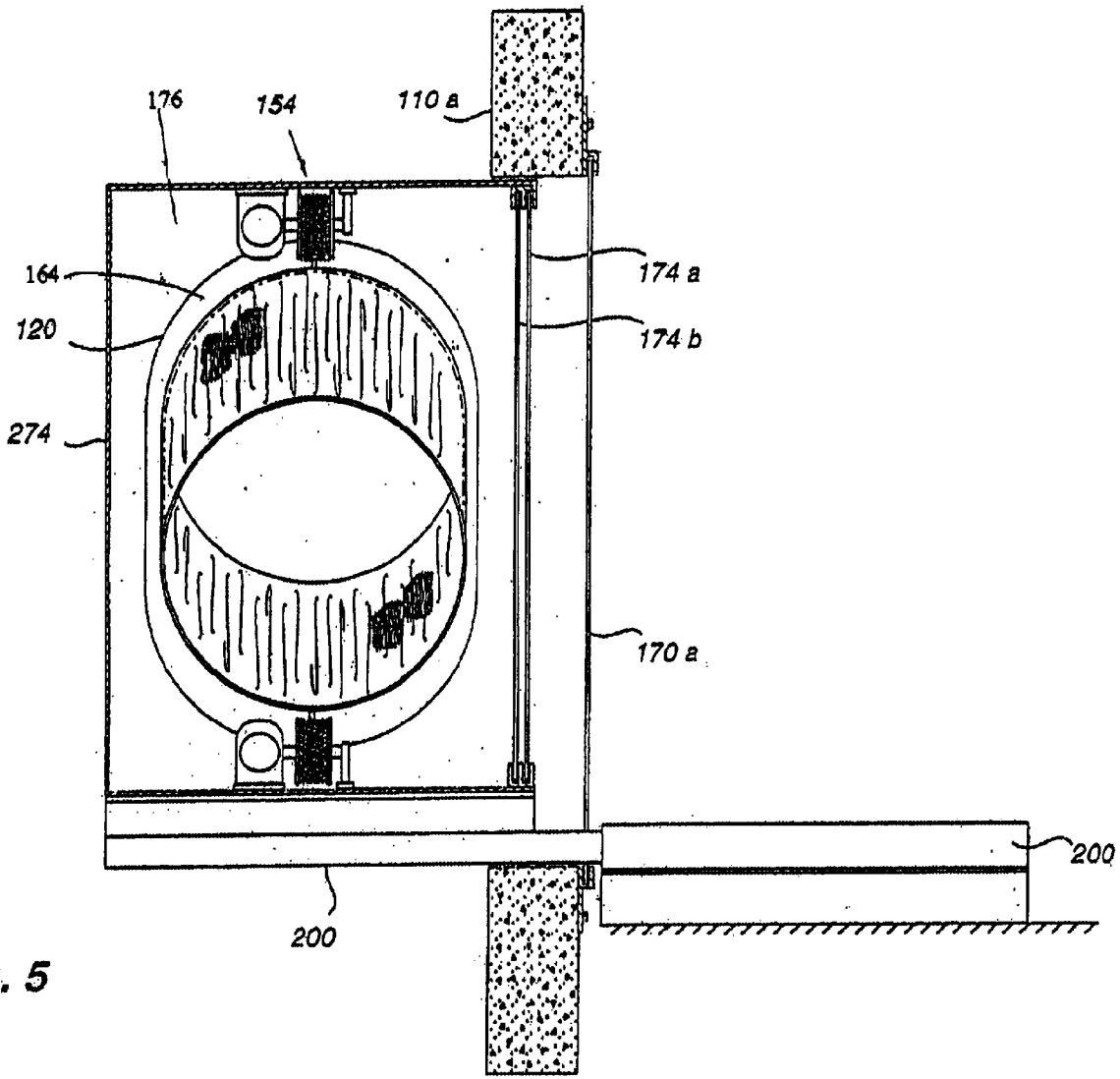
FIG. 5 shows the sleeve-storage compartment in its outdoors extracted, ready to activate position.

The operation of the rescue system remains the same (FIG. 1) after the compartment 150 as a whole has been pushed on the rail systems 200 out of the building wall 110*a* as seen in FIG. 5.

The foregoing example has been shown as a left-hand side directed unit, but the same design principles are of course applicable with respect to oppositely directed rescue system.

Various changes and modifications of the invention will be apparent.

What is claimed is:

1. A system particularly useful for the evacuation of individuals from an elevated level of a building having an exterior wall and an exit opening therethrough; said system comprising:

a housing slidably mounted, to said building in alignment with said exit opening to move linearly from a stored position within said exit opening in said exterior wall, and to an operative position projecting outwardly from said exterior wall and defining a compartment in said housing;

and a flexible sleeve folded into a compact form for storage within said compartment, and unfoldable into an operative form extending outwardly from said compartment to permit individuals to exit therethrough from the building;

said flexible sleeve having an entry end secured with respect to said housing, and an exit end to be secured to a stable object at a lower level in the extended operative form of the flexible sleeve;

said housing including a front wall and a rear wall located vertically, and substantially parallel to the building exterior wall with said rear wall in alignment with said exit opening, said housing further including a pair of lateral walls extending vertically on opposite sides of said front and rear walls, and substantially perpendicular to the building exterior wall, when said housing is mounted to the building;

one of said lateral walls being formed with an opening in alignment with said entry end of the flexible sleeve, such that in the extended operative form of the flexible sleeve, it extends at an incline diagonally alongside the building exterior wall, thereby facilitating the securing of the exit end of the flexible sleeve to a stable object located relatively close to the building, and the evacuation of individuals entering the flexible sleeve in a sitting position at the entry end.

2. The system according to claim 1, wherein said flexible sleeve comprises at least an upper tension cable engageable with an upper portion of the flexible sleeve for supporting the flexible sleeve in its extended operative form at an incline diagonally alongside the building exterior wall.

3. The system according to claim 2, wherein the system also comprises a lower tension cable engageable with a lower portion of the flexible sleeve for supporting the flexible sleeve in its extended operative form at an incline diagonally alongside the building exterior wall.

4. The system according to claim 3, wherein said compartment further comprises first and second winches coupled to said upper and lower tension cables for drawing said flexible sleeve into said compartment.

5. The system according to claim 4, wherein said compartment further comprises a backing plate extending parallel to said one lateral wall and formed with an opening aligned with and joined to said entry end of the flexible sleeve providing access into the entry end of said flexible sleeve.

6. The system according to claim 5, wherein said backing plate is movable away from said one lateral wall to accommodate the flexible sleeve in a folded condition when drawn into said compartment by said winches.

7. The system according to claim 6, wherein said compartment further includes a guide tube for each of said tension cables located between the respective winch and said backing plate and guiding the displacement of said backing plate.

8. The system according to claim 7, wherein said guide tubes are spaced apart within said compartment a greater distance than the transverse dimension of the entry end of the flexible sleeve such that the flexible sleeve is folded in a zig-zag space-saving fashion when drawn into said compartment.

9. The system according to claim 7, wherein each of said guide tube includes a compression spring for urging said backing plate in the direction of ejecting said flexible sleeve from said compartment.

10. The system according to claim 2, wherein said flexible sleeve includes a plurality of annular sections interconnected together, each section being made of strong flexible sheet material attached to and supported by a rigid ring; and wherein said upper and lower tension cables pass through eyelets carried by upper and lower portions of said rigid rings.

11. The system according to claim 1, wherein said rear wall includes a sliding door to provide access into the interior of said compartment.

12. The system according to claim 1, wherein said housing is mounted to said building on rails.

* * * * *